United States Patent [19]

Kishi et al.

[11] Patent Number: 5,037,675

[45] Date of Patent: Aug. 6, 1991

[54] METHOD OF COATING ALUMINUM SURFACE

[75] Inventors: Mikio Kishi; Kazuaki Okada; Susumu Takubo, all of Tokyo, Japan

[73] Assignee: Fujimaru Kogyo Kabushiki Kaisha, Tokyo, Japan

[21] Appl. No.: 416,562

[22] Filed: Oct. 3, 1989

[30] Foreign Application Priority Data

Oct. 4, 1988 [JP] Japan ..... 63-249035

[51] Int. Cl.[5] ..... B05D 3/02; B05D 5/08

[52] U.S. Cl. ..... 427/258; 427/270; 427/287; 427/379

[58] Field of Search ..... 427/258, 287, 409, 419.6, 427/270, 379

[56] References Cited

U.S. PATENT DOCUMENTS 4,118,537 10/1978 Vary et al. ..... 427/409 X
4,546,141 10/1985 Gebauer ..... 427/409 X

FOREIGN PATENT DOCUMENTS 47-17636 5/1972 Japan ..... 427/409

*Primary Examiner*—Evan Lawrence
*Attorney, Agent, or Firm*—Dykema Gossett

[57] ABSTRACT

A method of coating an aluminum surface in which the aluminum surface is initially roughened. Enamel containing borosilicate frit is then coated discontinuously on the roughened aluminum surface so that it covers 20 to 60% of the surface and is baked. A first fluorocarbon resin coating is then placed on the enamel and dried. A second fluorocarbon resin coating is then placed over the first coating and baked.

3 Claims, No Drawings

METHOD OF COATING ALUMINUM SURFACE

BACKGROUND OF THE INVENTION

1. Field of the Invention

The present invention relates to a method of providing a cooking utensil or the like made of aluminum with a non-sticking coating of a fluorocarbon resin.

2. Description of the Prior Art

It is known to provide a fluorocarbon resin coating on a surface of a cooking pan or the like to prevent sticking of a food or the like to the surface. Since generally a fluorocarbon resin does not have a high adhesive strength to a surface of a base of a metal or the like, various methods have been proposed for adhering a fluorocarbon resin coating layer to a surface of a metal base with a sufficient strength to assure a practical use. For example, according to one of known methods, a surface of a base is mechanically or chemically roughened to raise the adhesive strength of the base. According to another known method, a primer coating material is utilized wherein a fluorocarbon resin co-exists with a substance which exhibits a high adhesive strength to a metal base. A further method has been proposed wherein various fillers are mixed in a fluorocarbon resin to be coated in order to improve the adhesion to a metal base.

A still further method is disclosed in Japanese Patent Publication No. 47-17636. According to the method, a surface of a shaped aluminum article is degreased and then enamel produced by adding an opacifier, a pigment agent, an addition agent and water to a borosilicate frit is coated on part or the entirety of the surface by spraying, thereafter the enamel is dried and baked and then a tetrafluoroethylene resin is coated on the surface of the enamel.

However, when a cooking pan with a fluorocarbon resin coating produced by any such conventional methods is actually used, there are drawbacks in that the resin coating may be partially swollen to rise from the base though it is not exfoliated. Further, if the resin coating is rubbed strongly by means of a spatula made of a metal or the like, then it is likely to be scraped to expose the surface of the base. Also, there is a problem that the coating may be damaged to likely cause foreign substances to stick to the cooking span.

SUMMARY OF THE INVENTION

Accordingly, it is an object of the present invention to provide an aluminum article with a fluorocarbon resin coating wherein the adhesive strength of the fluorocarbon resin coating provided on an aluminum surface is improved to allow use of the aluminum article for a long period of time.

In order to attain such an object as described above, according to the present invention, a coating of a higher adhesion was successfully obtained by improving the method of coating a fluorocarbon resin after baking enamel containing borosilicate frit therein on an aluminum surface which method is the prior art described hereinabove.

In particular, the present invention is a method of coating an aluminum surface which is characterized in that a fluorocarbon resin coating is formed on a roughened aluminum surface after enamel which contains borosilicate frit as a principal component therein is coated on the roughened surface and baked. The enamel is coated discontinuously such that it may cover 20 to 60% of the aluminum surface and then fused and adhered to the aluminum surface by baking, and then a fluorocarbon resin dispersed coating material which contains 25 to 50% by weight of a silica filler with respect to a fluorocarbon resin is coated and dried such that the average thickness may be 3 to 7 μm. A fluorocarbon resin dispersed coating material containing a filler therein is then further coated and baked in such a manner that the thickness thereof may be at least 25 μm.

The aluminum surface to which the method of the present invention is applied is not limited to an article made of aluminum such as, for example, a pan for cooking or a frying pan but otherwise may be an iron-aluminum clad product or a stainless steel-aluminum clad product or may be any shaped article irrespective of its configuration or application on condition that it has an exposed surface of an aluminum alloy or the like. The aluminum surface of such shaped article may be roughened to a roughness of 1 to 20 μm or so by applying, after cleaning thereof, etching, blasting or some other mechanical roughening method singly or in combination in accordance with a normal procedure.

Borosilicate frit which is a principal component of enamel used in the present invention contains $B_2O_3$ and alkali metal oxides mixed in $SiO_2$, and such borosilicate frit presents a high adhesion to an aluminum surface with a baking condition, for example, of 500° to 550° C. or so. Such enamel contains, in addition to the frit described above, a powder filler or fillers of silica, aluminum or titania and/or an opaquer suitably mixed therein and further contains a small amount of a suspending agent or a binder. The enamel is thus adjusted by means of a solvent such as water so as to present a viscosity suitable for coating.

In order to coat such roughened aluminum surface with enamel, a spray coating method may be adopted. Upon such coating, an electrostatic coating device may be used, but otherwise an air spray device which makes used of high pressure air may be employed. The amount of enamel to be coated thereupon must not be so great as to cover the entire aluminum surface, but should not be too small because then there is no effect. Upon such coating of enamel, drops of enamel coated on the aluminum surface should adhere in the form of discontinuous dots to the aluminum surface, and it is necessary to make an adjustment such that 20 to 60% of the aluminum surface may be covered with masses of the enamel after baking. If the area of the aluminum surface covered with the enamel is smaller than 20%, then the adhesive strength of the fluorocarbon resin coating adhered thereon will be deteriorated, which will increase such defects as exfoliation. On the contrary, if the area exceeds 60%, then the fluorocarbon resin will be likely damaged by an external force, and consequently, abrasion or exfoliation will likely occur.

The shaped aluminum article coated with the enamel in this manner is dried and then baked at a temperature of 500° to 550° C. so as to cause masses of enamel particles to be fused and adhered in the form of discontinuous dots to the aluminum surface. The enamel masses adhered in this manner preferably have such sizes that the diameter ranges from 20 to 70 μm and the thickness ranges from 2 to 10 μm or so.

A fluorocarbon resin dispersed coating material to be applied as a primer to an aluminum surface on which enamel is baked in the present invention preferably contains a powder filler of silica by 25 to 50% by weight with respect to a fluorocarbon resin contained in the coating material. When the content of the filler is small, the adhesive strength of the primer to the aluminum base is low, but when the content of the filler is too great, the adhesive strength to the fluorocarbon resin coating adhered to the filler is insufficient.

It is necessary for such primer to be applied such that the average thickness thereof after drying may be 3 to 7 μm. If the thickness of the primer applied is too small, then such defects as partial exfoliation of the fluorocarbon resin coating will increase, but on the contrary if the thickness is too great, then destruction at the primer layer will likely occur.

When a fluorocarbon resin dispersed coating material is applied, after drying, as a top coating on the surface on which the primer is applied, such coating material contains a filler therein. While the filler used here is not limited to a particular one, desirably it is selected from materials having a high hardness if possible, and desirably the content thereof in the coating material is not greater than the content of the filler in the coating material for the primer. It is necessary for such top coating to be formed by application in such a manner that the average thickness after drying may be at least 25 μm. To this end, such application may be carried out once or a plurality of times. When the application is carried out by a plurality of times, coating materials having different compositions may be applied successively, one on the other, instead of using a fluorocarbon resin dispersed coating material of the same composition. Particularly when coating materials whose filler contents are different from each other are used, a fluorocarbon resin coating which is tough and high in abrasion resistance can be obtained. This is particularly true if a coating material wherein the content of a filler is comparatively high is used for a lower layer and another coating material wherein the content of a filler is comparatively low is applied in an overlapping relationship as an upper layer. The aluminum article to which the primer and the top coating are applied in this manner is then baked at a temperature suitable to the type of the fluorocarbon resin contained in the coating material used. The fluorocarbon resin coating thus obtained is tough and is particularly superior in non-sticking property if the thickness of the top coating is greater than 25 μm.

DETAILED DESCRIPTION OF THE PREFERRED EMBODIMENT

An inner surface of a frying pan obtained by press work using an aluminum alloy plate (JIS #1100) was roughened by air blasting of alumina abrasives such that the average roughness (Ra) might be 4.5 to 5.2 μm.

Subsequently, enamel prepared by adding such addition agents as silica, titania and powder of sodium borate to a principal component of a borosilicate frit for aluminum and adjusting the concentration to about 57% with water was lightly sprayed uniformly onto the roughened surface by means of an air spray. Then, the frying pan was dried at a temperature of 130° C. and then baked at a temperature of 550° C. Consequently, masses of fused frit having diameters ranging from 20 to 50 μm were adhered in the form of dots to the aluminum surface, and some of the masses were integrated with adjacent frit masses so that they presented up to 100 μm or so.

The surface to which the enamel was applied and baked discontinuously in this manner was examined using a microscope photograph to find out a rate of the coated area. The rate thus obtained was about 30%.

Subsequently, a primer in the form of latex wherein powder of silica was mixed at a rate of about 40% in weight with a tetrafluoroethylene resin was applied uniformly to the enamel baked surface of the frying pan by means of an air spray such that the average thickness might be 3.5 μm, and then the frying pan was dried at a temperature of 180° C. in a furnace.

Further, emulsified liquid of a tetrafluoroethylene resin to which powder of titania and a coloring pigment were added was applied as a coating material for a top coating by spraying such that the thickness of the applied film might be about 30 μm, and then the frying pan was dried at a temperature of 60° C. The frying pan to which the fluorocarbon resin coating material was applied in this manner was heat processed in the condition of a highest temperature of 430° C. in a baking furnace to form the baked coating of the fluorocarbon resin.

The fluorocarbon resin coating on the aluminum surface obtained in this manner was very high in adhesion strength to the base. An attempt was made to exfoliate the fluorocarbon resin coating using a scraper or the like, but the coating was only damaged at a surface thereof and could not be exfoliated from the base.

According to a coating method of an aluminum surface of the present invention, a tough and corrosion resisting fluorocarbon resin coating which adheres firmly to an aluminum surface can be formed. A product can be obtained which is improved significantly in durability comparing with a fluorocarbon resin coated product obtained by a conventional method.

We claim:

1. A method of coating an aluminum surface comprising the steps of:

coating an enamel which contains borosilicate frit as a principal component therein on a roughened aluminum surface, such enamel being coated discontinuously such that it covers 20 to 60% of the aluminum surface, and then baking the enamel such that it is fused and adhered to the aluminum surface;

then applying to the enamel a first flurocarbon resin dispersed coating material which contains 25 to 50% by weight of a silica filler with respect to the fluorcarbon resin and drying said coating material such that the average thickness is 3 to 7 μm; and then applying to said first fluorocarbon resin dispersed coating material a second fluorocarbon resin dispersed coating material containing a filler and baking said second coating material in such a manner that the thickness thereof is at least 25 μm.

2. A method as claimed in claim 1, wherein coating of the enamel to the aluminum surface is carried out by a spray coating means.

3. A method as claimed in claim 1 or 2, wherein the enamel is applied discontinuously such that the enamel masses adhered to the aluminum surface range from 20 to 70 μm in diameter.

* * * * *